US005147079A

United States Patent [19]

Heather

[11] Patent Number: 5,147,079

[45] Date of Patent: Sep. 15, 1992

[54] CARRIER DEVICE FOR CONTAINERS

[76] Inventor: Campbell S. N. Heather, Zum Talblick 19, 6246 Glashütten 1, Fed. Rep. of Germany

[21] Appl. No.: 622,255

[22] Filed: Dec. 4, 1990

[30] Foreign Application Priority Data

Sep. 28, 1990 [DE] Fed. Rep. of Germany ..... 4030770

[51] Int. Cl.[5] ..... A45F 5/00

[52] U.S. Cl. ..... 224/148; 224/205; 224/257; 206/428; 294/157; 220/737

[58] Field of Search ..... 224/148, 205, 257, 258, 224/201, 202; 220/85 H, 737, 738, 739, 740, 741, 742; 206/427, 428, 142, 143; 294/31.2, 137, 149, 150, 157; 222/175

[56] References Cited

U.S. PATENT DOCUMENTS

| | | | |
|---|---|---|---|
| 1,825,897 | 10/1931 | Brooke | 224/148 X |
| 2,630,258 | 3/1953 | Calzolari | 294/137 X |
| 3,202,309 | 8/1965 | Simpson | 220/85 H |
| 3,820,695 | 6/1974 | Pecjak | 224/148 |
| 3,913,778 | 10/1975 | Oglesbee | 220/23.83 |
| 3,930,578 | 1/1976 | Stein | 206/428 X |
| 4,176,772 | 12/1979 | Danon | 224/148 |
| 4,390,095 | 6/1983 | Cunningham | 206/428 X |
| 4,696,403 | 9/1987 | Hoover | 206/428 X |
| 4,796,937 | 1/1989 | Andrea | 294/31.2 |
| 4,804,218 | 2/1989 | Hilliard | 294/31.2 |
| 4,979,659 | 12/1990 | Boyd | 224/205 |

FOREIGN PATENT DOCUMENTS

| | | | |
|---|---|---|---|
| 8534002 | 5/1987 | Fed. Rep. of Germany . | |
| 8709205 | 10/1987 | Fed. Rep. of Germany . | |
| 1325592 | 3/1964 | France | 224/148 |
| 1436033 | 3/1966 | France . | |
| 2615078 | 11/1988 | France | 224/148 |
| 8501641 | 4/1985 | PCT Int'l Appl. | 224/148 |

OTHER PUBLICATIONS

"Sport-Scheck" Catalog of Mar. 1983, pp. 187 and 478.

*Primary Examiner*—Henry J. Recla
*Assistant Examiner*—Glenn T. Barrett
*Attorney, Agent, or Firm*—Panitch Schwarze Jacobs & Nadel

[57] ABSTRACT

The invention relates to a carrier device for containers, particularly plastic bottles, which may readily carried along by a person and permits a liquid supply to be readily handled. According to the invention, there is provided a strap assembly for the container, in connection with a shoulder strap, the strap assembly comprising at least a first and a second longitudinal strap defining a holding space for a container, particularly a drinking bottle.

14 Claims, 3 Drawing Sheets

CARRIER DEVICE FOR CONTAINERS

DESCRIPTION

The invention to a carrier device for containers, particularly for plastic bottles.

There are many cases, in situations for instance of heavy physical stress, under hot climatic conditions etc, when it appears desirable to carry a drinking liquid supply along, which should not, however, interfere with the carrier's freedom of movement, and should particularly leave his hands free for necessary activities in the field, for instance in the course of training operations or the like.

In the case of military equipment, this desire is generally met by the provision of particular, mostly thermally insulated canteens made of metal or plastic material and adapted to be attached to the user's belt. These canteens have only a very limited capacity, however, requiring them to be frequency refilled, and are unsuitable for containing carbonated beverages such as mineral water. The attachment of the canteen to the belt moreover requires special fasteners which may sometimes hamper ready access to the bottle.

Known, from FR Patent 14 36 033 is a carrier device made of decorator's strips, which has been found unsatisfactory, however, under wear and tear conditions, and does not under all circumstances ensure the sufficiently reliable carrying of a drinking bottle.

In the case of recreational activities, beverage bottles usually made of plastic materials in the form of canteens, or simply conventional water bottles, are frequently carried in shoulder strap bags or other receptacle containing other items, in which case there is the danger of leaking, and retrieving of the bottle requires a sequence of manipulations which it would appear desirable to simplify.

It is therefore an object of the invention to provide a carrier device for containers, particularly bottles, which enables a person to carry the container in an uncomplicated and at the same time safe and effortless manner, so that the person's hands remain free, and which moreover enables conventionally available beverage bottles, particularly plastic bottles, to be safely and reliably carried along, and permits such containers to be readily handled and if need be replaced.

The invention is specifically directed to a carrier device for containers, particularly bottles, which permits a relatively ample beverage supply to be carried along.

In a carrier device of the type defined in the introduction this object is attained according to the invention by the provision of a strap assembly adapted to non-loseably retain the container and connected to a shoulder strap.

In a preferred embodiment of the invention, particularly for carrying a drinking bottle preferably made of a plastic material in a commercially available large-capacity size, the strap assembly comprises at least four longitudinal strap sections circumferentially spaced by substantially 90° and extending in the longitudinal direction of the container, specifically the drinking bottle, and connected to one another at least so as to form a bottom support portion.

In the circumferential direction, the longitudinal strap sections are interconnected and held in stable position at least at an upper location by an upper circumferential strap.

In order to safely retain the bottom end portion of the drinking bottle, the longitudinal strap sections are preferably interconnected by a bottom-side circumferential strap.

The stable retention of the container, or of a drinking bottle, respectively, in the strap assembly is further improved by the provision of an intermediate circumferential strap interconnecting the longitudinal strap sections at an intermediate location, preferably halfway between the upper and bottom-side circumferential straps.

In an advantageous embodiment of the carrier device for carrying a container, preferably a plastic drinking bottle containing a carbonated non-alcoholic beverage, for instance mineral water, pairs of oppositely located longitudinal strap sections are integrally formed by a first and a second longitudinal strap. For the formation of the bottom support portion for the container or the drinking bottle, respectively, the longitudinal straps intersect at right angles and are connected to one another at the intersection, particularly by high-strength sewing.

In a simplified construction of the strap assembly for the retention of the container or the drinking bottle, respectively, the first longitudinal strap, which when a drinking bottle is inserted in the strap assembly, extends in the longitudinal direction of the drinking bottle along the outer surface thereof down to its bottom, extends diametrically thereacross, and extends upwards along the opposite outer surface of the drinking bottle, and is fixedly connected at opposite locations to the upper and/or the bottom-side and/or the intermediate circumferential strap, is extended to integrally form the shoulder strap.

In order to ensure the safe and non-loseable retention of the container or drinking bottle, respectively, in the strap assembly even in the case of rapid or vehement movements of a person carrying the drinking bottle in the strap assembly, the second longitudinal strap is preferably provided or connected, respectively, with or to an upper container securing means. In accordance with this provision, and again provided that a drinking bottle is in the strap assembly, the second longitudinal strap extends downwards from the upper circumferential strap along the outer circumferential surface of the bottle at a 90° offset position with respect to the first longitudinal strap, passes across the bottom of the bottle so as to form an intersection with the first longitudinal strap, whereat it is securely sewn to the first longitudinal strap, and then extends upwards along the bottle to the upper circumferential strap at a diametrally opposite location. The second longitudinal strap may losely pass across the spout or neck portion of the bottle and have an extended free end portion adapted to be brought into retaining engagement with a retainer element provided on the other, shorter end portion of the second longitudinal strap.

Preferably, however, the second longitudinal strap is provided with respective securing buckles at both of its ends. In order to ensure the safe and non-loseable retention of a drinking bottle in the strap assembly, and at the same time to permit the drinking bottle, which in the inserted state forms an integral unit with the strap assembly, to be readily handled and used, there is provided a separable securing element, preferably a metal or plastic ring, adapted to enclose a spout or neck portion of the container or drinking bottle, respectively, and connected at diametrally opposite locations to a pair of securing strap sections the free ends of which are retained by the securing buckles in a longitudinally adjustable manner.

In order to permit the carrier device with a bottle therein to be readily laid down or taken up, or also to facilitate the replacement of the carrier device as a whole, the first longitudinal strap may have a short first end at the container side provided with a clasp portion of a snap clasp combination, and on the opposite side a long second end forming the shoulder strap and provided with a tongue portion releasably engageable with the clasp portion in a snap fit.

The longitudinal and circumferential straps of the strap assembly including the shoulder strap preferably consist of a high-strength synthetic fibre material or synthetic-fibre-reinforced textile material, for instance high-strength military webbing. It is further preferred that all of the intersecting portions of the longitudinal and circumferential straps are securely interconnected, particularly by high-strength sewing.

According to another embodiment of the invention, the strap assembly is designed to retain a plurality of containers, or at least two bottles, respectively, preferably made of a plastic material, in which case the strap assembly comprises a first and a second holding unit, each unit consisting of at least three longitudinal strap sections extending at 90° offset positions and separately or jointly interconnected at least by an upper circumferential strap, and connected to one another so as to form a bottom support portion.

Further preferred embodiments of the subject matter of the invention are set forth in the remaining subclaims.

Embodiments of the invention shall now be explained in detail by way of example with reference to the accompanying drawings, wherein.

Figure 1:
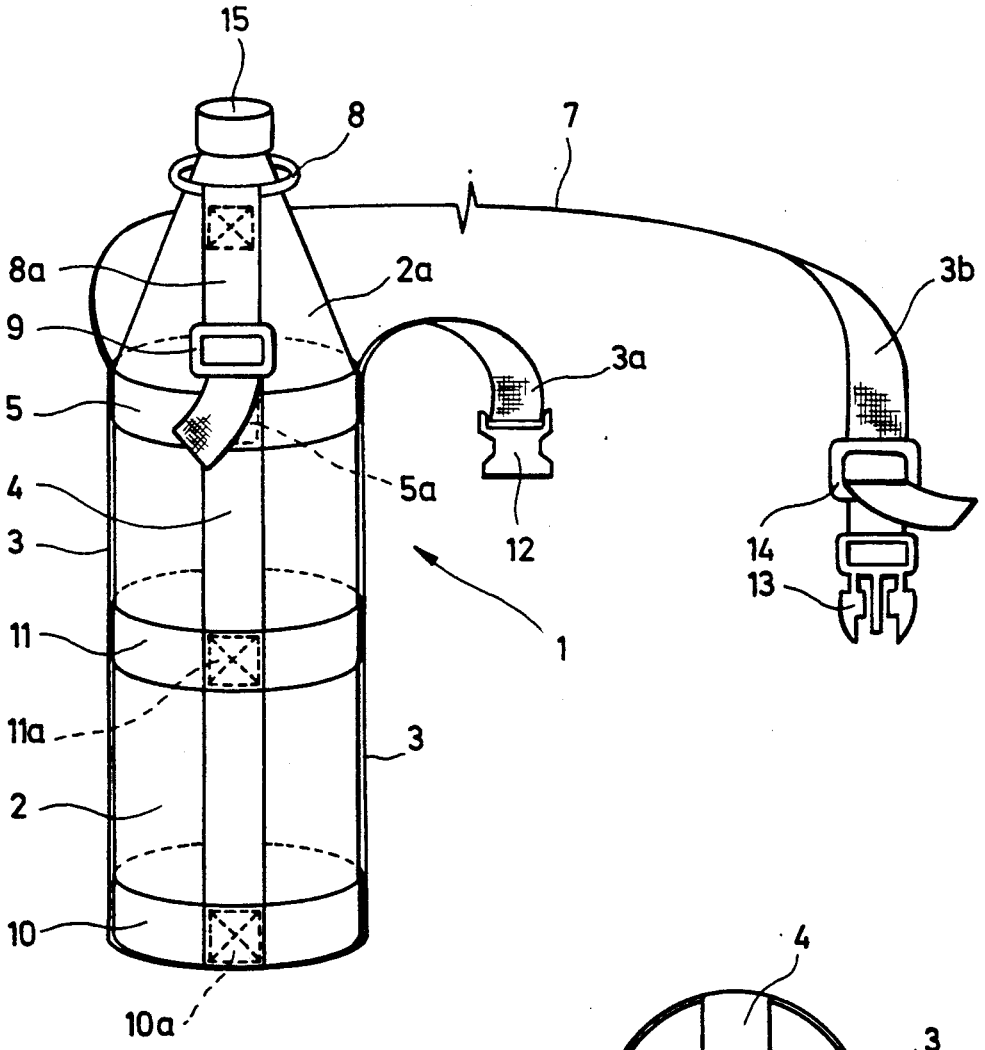
FIG. 1 shows a first embodiment of the invention in the form of a carrier device with a plastic drinking bottle inserted therein.
Figure 2:
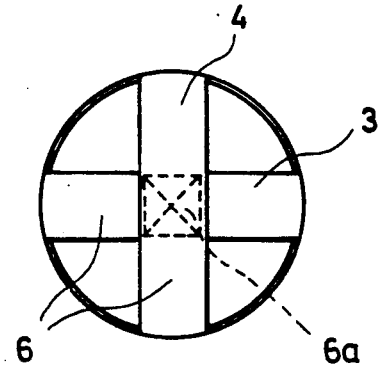
FIG. 2 shows a bottom plan view of the FIG. 1 embodiment.

Shown in FIGS. 1 and 2 is a first embodiment of a carrier device 1 according to the invention, designed for carrying a commercially available, conventional drinking bottle 2, preferably a throw-away or returnable bottle made of a plastic material (PTE, PVC) with a relatively great capacity. A drinking bottle 2 of this kind may for instance be filled with a non-alcoholic carbonated beverage, e.g. mineral water, lemonade, a cola-containing beverage or the like, intended to be carried along for instance by soldiers during military operations, or to serve as a refreshment on excursions or other outdoor activities.

Carrier device 1 enables drinking bottle 2 to be safely retained and readily inserted by the provisions of a first longitudinal strap 3 and a second longitudinal strap 4 connected in the example shown to an upper circumferential strap 5 loosely fitting the outer diameter of the drinking bottle 2 to be carried. From upper circumferential strap 5 longitudinal straps 3 and 4 extend downwards in the longitudinal direction of drinking bottle 2, and across the bottom thereof, whereat they intersect to thereby for a bottom support portion 6 for drinking bottle 2 (cf. FIG. 2). At diametrally opposite locations, longitudinal direction of bottle 2, to be again connected to upper circumferential strap 5. The first longitudinal strap 3 of the two is considerably extended to form an integral shoulder strap 7, while the second longitudinal strap 4 is provided with—or connected to—a securing and closure means 8, 9 which serves for retaining drinking bottle 2 non-loseably in carrier device 1, First and second longitudinal straps 3 and 4 are preferably made of a high tensil-strength synthetic fibre material or a synthetic-fibre-reinforced textile material of high strength, of the type for instance widely employed as carrying straps for field packs or similar items of military equipment. It is of course also possible to employ other types of webbing or strap material which has a high tensile strength and is inexpensively available in the form of an endless coil of material in various widths.

First and second longitudinal straps 3 and 4 extend along the circumferential surface of a cylinder parallel to its axis at a 90° spacing, so that the formation of the cruciform bottom support portion 6 by the transversely extending sections of straps 3 and 4 results in the drinking bottle 2 is circumferentially retained at 90° spacings (cf. FIG. 2). At their intersection 6*a*, the bottom sections 3*a* and 4*a* of first and second longitudinal straps 3 and 4 are firmly sewn together, so that drinking bottle 2 can be supported without shifting. Upper circumferential strap 5, which is located at the base of an upper conical neck portion 2*a* of drinking bottle 2, and to which first and second longitudinal straps 3 and 4 are securely connected, specifically fixedly sewn at respective intersection points 5*a*, contributes to the stability of carrier device 1 and to the reliable retention of drinking bottle 2 in carrier device 1 by conforming to the geometry of the drinking bottle, and ensures the positioning of first and second longitudinal straps 3 and 4 relative to one another in the circumferential direction. A similar purpose is served by a bottom-side circumferential strap 10 fixedly connected, particularly securely sewn to first and second longitudinal straps 3, 4 at respective intersections 10*a*. In this manner there is provided a strap frame of a configuration conforming to the geometry of the drinking bottle to be carried, and of low weight for easy handling.

In the embodiment illustrated in FIG. 1, an additional intermediate circumferential strap 11 is provided at an intermediate position along the length of drinking bottle 2 or of first and second longitudinal straps 3 and 4, respectively, for additional position stabilization of carrier device 1, and at the same time for additional protection of drinking bottle 2 from damage by external forces, strap 11 being again fixedly connected, particularly securely sewn, to first and second longitudinal straps 3, 4 at respective intersections 11*a*.

In the present case, drinking bottle 2 has a circular cross-sectional shape with a diameter of for instance 9.5 cm, and a height of for instance 23 cm as measured at the base of conical neck portion 2*a*. Longitudinal and circumferential straps 3, 4 and 5, 10 and 11, respectively, may have a width of for instance 2.5 to 3 cm. The adjustable length of shoulder strap 7 is preferably about 132 cm.

Adjacent upper circumferential strap 5 first longitudinal strap 3 has a short first end 3*a* with a clasp portion 12 for the engagement of a tongue portion 13 provided at the other end 3*b* of the shoulder strap 7 formed by the extension of first longitudinal strap 3. Tongue portion 13 is a plug-in member adapted to be releasably engaged with clasp portion 12 and associated to a length-adjustment mechanism formed in the manner of a conventional twin-buckle arrangement.

Thus design does not only enable the carrier device 1 with the drinking bottle 2 therein to be readily hitched on and off without having to pass shoulder strap 7 over the head of a person carrying carrier device 1 in an across-body hanging position, but does also permit the length of shoulder strap 7 to be adjusted to the height of the person desiring to carry drinking bottle 2 with the aid of carrier device 1.

For safely and non-loseable retaining drinking bottle 2 in carrier device 1, second longitudinal strap 4 is provided with safety securing means, which in the embodiment of the invention according to FIG. 1 comprises a metal or plastic ring 8 secured to an upwards extended end of second longitudinal strap 4, and a securing strap section 8*a* attached to ring 8 and having its free end provided with a buckle 9 in which the free first end of a second longitudinal strap 4 is frictionally retained. Securing strap section 8*a* preferably has an adjustable length of about 16.5 cm.

In a modified embodiment, two securing strap sections 8*a* of adjustable length are provided in connection with second longitudinal strap 4, the free end of each strap section 8*a* carrying a securing buckle 9 for connection to second longitudinal strap 4. The two securing strap portions 8*a* extend on opposite sides of a bottle closure cap 15 from a metal or plastic ring 8 towards the connection with second longitudinal strap 4 by means of the respective buckles 9.

Optionally the length of first and second longitudinal straps 3 and 4 and/or of circumferential straps 5, 10 and 11 may be adjustable to permit carrier device 1 to be adjusted to drinking bottles 2 of different sizes or cross-sections. In this case, self-clamping slip seat connectors may be selected for the connections of longitudinal and/or circumferential straps 3, 4 and 5, 10, 11, respectively.

As also evident from FIG. 1, the length both of the upwards extended free end of second longitudinal strap 4 at the rear (not visible in FIG. 1) or of the (not visible) rear securing strap section 8*a*, respectively, extending from metal or plastic ring 8, and of the front securing strap section 8*a*, is determined so that this section of second longitudinal strap 4 or the safety retaining means formed in combination with metal or plastic ring 8 and securing strap section(s) 8*a* extends across the upper portion of neck section 2*a* adjacent the spout of bottle 2, so that drinking bottle 2 is reliably prevented from dropping out of carrier device 1 even when the latter is inverted by 180°. To this purpose metal or plastic ring 8 is slipped over the screw cap 15 of drinking bottle 2 as shown in FIG. 1. In this manner, the use of drinking bottle 2 to drink therefrom does not require any release manipulations to be preformed on carrier device 1, it being rather possible to simply unscrew screw cap 15 from drinking bottle 2 for making use of the latter while it is still safely retained in carrier device 1. Even if for some suddenly retained in carrier device 1 with drinking bottle 2 therein has to be released after having been grasped and raised for drinking, there is not danger that drinking bottle 2 is dropped, and possible lost, so that the user is not impeded in his freedom of movement and able at any instant to use both his hands for other activities.

The friction buckle 9 also permits the length of second longitudinal strap section 4 or of the two securing strap sections 8*a* connected to ring 8, respectively, to be readily adjusted in accordance with bottles of different shapes and lengths, respectively.

The invention is of course not restricted to the type of securing and adjustment means 9, 12, 13, 14 as illustrated, it being also possible to select other configurations in accordance with any given use. In place of the friction buckle fastener 9 for the connection of securing strap sections 8*a* to second longitudinal strap 4, it is thus for instance possible to employ a so-called Velcro fastener or the like. The friction buckle fastener 9 used for non-loseably retaining drinking bottle 2 in carrier device 1 has only to be opened for replacing drinking bottle 2, i.e. for the insertion of a new drinking bottle 2 into carrier device 1. By suitably selecting the lengths of first and second longitudinal straps 3 and 4, and the circumferential lengths of the circumferential straps, the carrier device can be devised to hold drinking bottles of different shapes, for instance square cross-sectional shape, and/or bottles of different sizes. The shoulder strap 7 may also be a separate length of strap having its opposite ends connected to first or second longitudinal strap or to a circumferential strap.

First and second longitudinal straps 3 and 4 may either be applied to the circumferential straps and secured thereto, specifically by sewing, from the outside, or this arrangement can be reversed, so that the circumferential straps extend around longitudinal straps 3 and 4 on their outside and fastened thereto, as by sewing, at the intersections.

Figure 3:
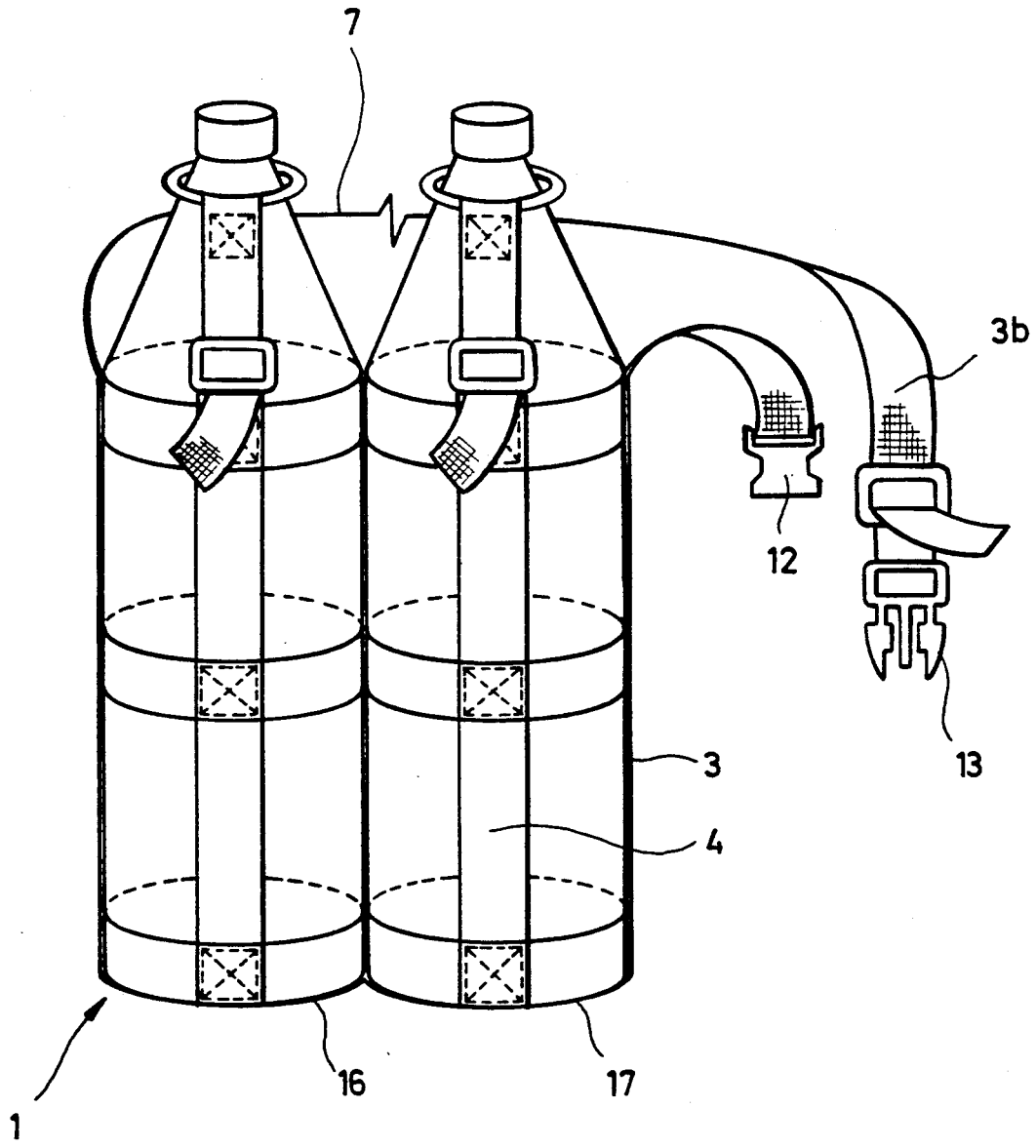
FIG. 3 shows another embodiment of the invention in the form of a carrier device designed for holding two plastic drinking bottles, and FIGS. 4(*a*) to (*c*) diagrammatic illustrations of alternative constructions of a carrier device according to the present invention, each for holding two drinking bottles.

FIG. 3 shows another embodiment of the carrier device according to the invention, which is designed for holding two drinking bottles 2. To this purpose, carrier device 1 comprises a first and a second holding unit 16 and 17, respectively, for carrying a drinking bottle 2 each. The carrier device 1 according to FIG. 3 permit a person to carry a still greater liquid supply in a comfortable manner, preferably by using plastic drinking bottles such as Cola bottles. In the embodiment of FIG 3, first and second holding units 16 and 17 are fixedly interconnected along vertically extending sections of first longitudinal strap 3, preferably at the locations of upper, intermediate and bottom-side circumferential straps 5, 11 and 10, respectively. It would also be conceivable, however, to provide only a single connecting strap extending in the connection plane between first and second holding unit 16 and 17 in the longitudinal direction between upper circumferential strap 5 and bottom-side circumferential strap 10, to which it would be fixedly connected, in which case first longitudinal strap 3 would extend downwards along holding unit 16, diametrally across the bottom portions of both holding units 16, 17, whereat it would be fixedly connected to he respective second longitudinally strap 4 at its intersections therewith, and then upwards again to integrally form shoulder strap 7 with its free end 3*b* carrying tongue member 13 of the snap clasp combination. Otherwise the embodiment according to FIG. 3 is a tandem arrangement of carrier device 1 according to FIG. 1, so that reference may be had to the above description for the remaining details.

Figure 4B:
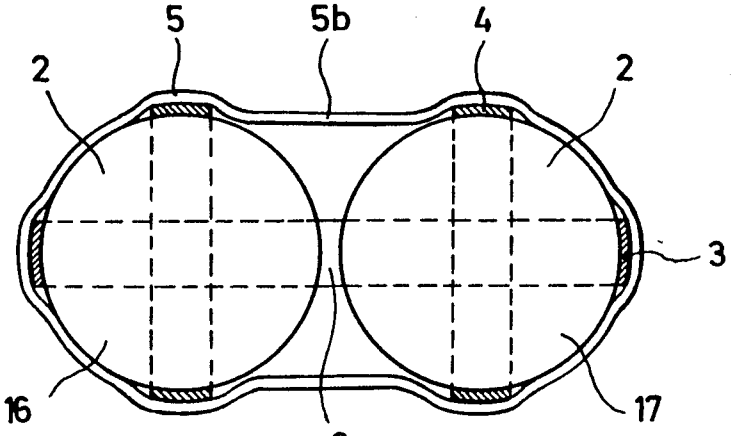
Figure 4A:
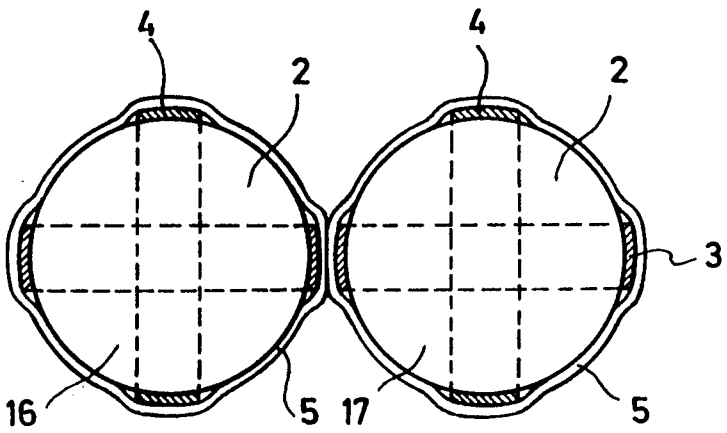
Figure 4C:
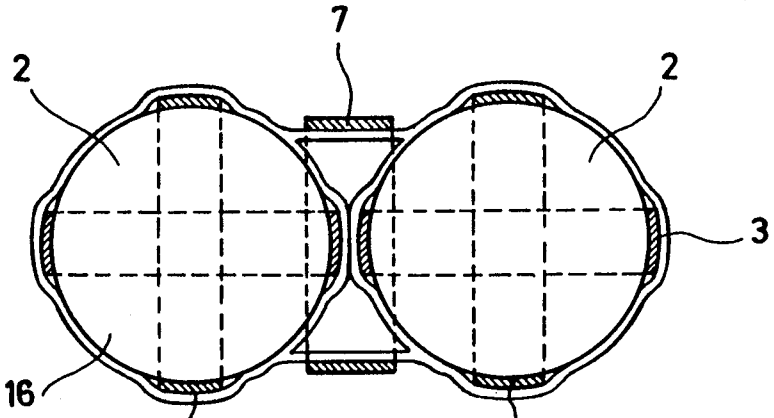

Shown in FIGS. 4*a* to 4*c* are diagrammatical cross-sectional top plan views—taken along the upper rim of upper circumferential strap 5—of various modifications of carrier device 1 for holding a pair of drinking bottles 2, comparable to the embodiment shown in FIG. 3. In all of these figures, circumferential straps 5 and 11, respectively, are shown to extend outwards of and thus encircling the respective actions of longitudinal straps 3 and 4. The connection between longitudinal straps 3, 4 and circumferential straps 5, 11 could also be reversed, however, that is, circumferential straps 5, 10, 11 could extend on the inside of longitudinal straps 3, 4 and be fixedly connected thereto at respective intersections 5*a*, 10*a*, 11*a*, as indicated in FIG. 2.

In FIG. 4*a*, first and second holding units 16 and 17 are connected to one another at the intersections between circumferential belts and adjacent sections of first longitudinal strap 3. First longitudinal strap 3 may also extend integrally across both bottom areas of carrier device 1 and be extended for the integral formation of shoulder strap 7, in which case a connection could be made in the gusset area between first and second holding unit 16 and 17 by using either the circumferential straps 5, 10, 11 alone or an additionally inserted longitudinal strap.

In FIG. 4*b*, first longitudinal strap 3 extends in the manner described above from one side of the carrier device, whereat it forms first strap end 3*a*, across the bottom areas of both holding units 16, 17 to the opposite side of the carrier device, whereat it forms the second strap end 3*b* (FIG. 1). At the same time, each of the circumferential straps, or at least upper circumferential strap 5, extends completely around both holding units 16 and 17. In this case, an intermediate section 5*b* at least of upper circumferential strap 5 may be provided on both sides with a metal clamp (not shown) or the like to thereby define respective seats for drinking bottles 2 in carrier device 1 to prevent the bottles from shifting.

FIG. 4*c* show still another embodiment of a carrier device 1 for holding two drinking bottles 2, in which a shoulder strap 7 provided separately from first longitudinal strap 3 is not attached to carrier device 1 along its longitudinal axis as in the FIG. 4*a* and 4*b* embodiments. Shoulder strap 7 instead extends in the transverse direction and is connected at least to upper circumferential strap 5 in the gusset area, In this manner, drinking bottles 2 are likewise safely retained in the two holding units 16 and 17, and the arrangement of the shoulder strap permits the carrier device to be readily taken up and carried. In this embodiment, shoulder strap 7 is preferably fixed connected also to the bottom-side section of first longitudinal strap 3. In a modification of FIG. 4*c*, it is also possible to employ an integral longitudinal strap 3 for both holding units 16 and 17, similar to the arrangement shown in FIG. 4*b*, with its opposite ends connected to upper circumferential strap 5.

The carrier device 1 according to the invention may be modified in any suitable manner, for instance to enable it to hold a greater number of container, particularly plastic drinking bottles. In any case, the carrier device is embodied in a lightweight structure requiring little space for storage in the empty state and permitting a person to comfortably carry a beverage supply. The lengths of longitudinal straps 3, 4 and circumferential straps 5, 10, 11 in connection with the safety and securing means 8, 8*a*, 9, 12, 13, 14 may be selected in accordance with the size and shape of the drinking bottles to be carried. The subject matter of the invention is not either restricted to the employ of containers having a conical neck portion 2*a* as shown in FIG. 1; the construction of the containers may rather be modified in accordance with numerous sizes and shapes of bottles and plastic containers actually on the market.

I claim:

1. A carrier device adapted for substantially vertically receiving a cylindrical drinking bottle having a top end and a bottom end, the carrier device comprising a strap assembly composed of longitudinal and transverse straps made of a flexible material, said carrier device comprising:

a first longitudinal strap adapted to extend around the drinking bottle from the top end to the bottom end thereof, across said bottom end and extending back to the top end thereof;

a second longitudinal strap adapted to extend around the drinking bottle from the top end to the bottom end thereof, across said bottom end and extending back to the top end thereof, said second longitudinal strap being approximately 90° circumferentially offset from said first longitudinal strap and having a free end;

said first and second longitudinal straps intersecting one another at right angles to form a bottom support portion and being fixed to one another at the intersection by sewing;

a first, upper circumferential strap adapted to receive a portion of the cylindrical drinking bottle proximate said top end thereof and interconnecting said first and second longitudinal straps, said first and second longitudinal straps each being fixed to said upper circumferential strap at two diametrically opposite positions;

a second, lower circumferential strap adapted to receive a portion of the drinking bottle proximate said bottom end thereof and adjacent to the bottom support portion and interconnecting said first and second longitudinal straps, said first and second longitudinal straps each being fixed to said lower circumferential strap at two diametrically opposite positions;

a third, immediate circumferential strap adapted to receive a portion of the drinking bottle substantially equidistant from the top end and the bottom end thereof and interconnecting said first and second longitudinal straps, said first and second longitudinal straps each being fixed at said intermediate circumferential strap at two diametrically opposite positions;

a shoulder carrying strap integrally formed from a first end of the first longitudinal strap;

an upper bottle closing means which closes said drinking bottle and comprises a support ring adapted to surround a mouth opening of the drinking bottle, said support ring being connected to a securing strap portion having a free end; and a fastening buckle which is disposed at the free end of the second longitudinal strap for attaching together the free end of said second longitudinal strap to the free end of said securing strap portion in a longitudinally adjustable manner.

2. A carrier device according to claim 1, wherein the support ring (8) is connected to an extended end portion of said second longitudinal strap (4).

3. A carrier device according to claim 2, wherein said support ring is a metal or plastic ring (8) loosely enclosing the drinking bottle (2), adjacent a spout or neck portion (2*a*, 15) thereof.

4. A carrier device according to claim 3, wherein said first longitudinal strap (3) has a short first end (3*a*) provided with a clasp portion (12) of a snap clasp combination (12, 13) adjacent a location of the container, and a long second end forming said shoulder strap (7) and provided with a tongue portion (13) releasably engageable with said clasp portion (12) in a snap fit.

5. A carrier device according to claim 4, wherein intersecting portions (5*a*, 10*a*, 11*a*) of said longitudinal and circumferential straps (3, 4, 5, 10, 11) are securely fixed to one another, particularly by sewing.

6. A carrier device according to claim 5, wherein said longitudinal and circumferential straps (3, 4, 5, 10, 11) and said strap assembly comprise of a synthetic fiber reinforced textile material, particularly a high strength military webbing.

7. A carrier device according to claim 6, wherein said drinking bottle (2) has a conical neck portion (2*a*) provided with a screw-cap spout (15) and having securing strap portions (8*a*), connected to said second longitudinal strap (4), extending diametrally thereacross.

8. A carrier device according to claim 7, wherein said first and second longitudinal straps (3, 4) are of adjustable length.

9. A carrier device adapted for substantially vertically receiving a cylindrical bottle having a top end and a bottom end comprising a strap assembly composed of longitudinal and transverse straps made of a flexible material, said carrier device comprising:

a first longitudinal strap adapted to extend around the drinking bottle from the top end to the bottom end thereof, across the bottom end and extending back to the top end thereof;

a second longitudinal strap adapted to extend around the drinking bottle from the top end to the bottom end thereof, across said bottom end and extending back to the top end thereof, said second longitudinal strap being approximately 90° circumferentially offset from the first longitudinal strap and having a free end;

said first and second longitudinal straps intersecting one another at right angles to form a bottom support portion and being fixed to one another at the intersection by sewing;

a first, upper circumferential strap adapted to receive a portion of the cylindrical drinking bottle proximate to the top end thereof and interconnecting said first and second longitudinal straps, said first and second longitudinal straps each being fixed to said upper circumferential strap at two diametrically opposite positions;

a second, lower circumferential strap adapted to receive a portion of the drinking bottle proximate the bottom end thereof and adjacent o said first and second longitudinal straps, said first and second longitudinal straps each being fixed to said intermediate circumferential strap at two diametrically opposite portions;

a shoulder carrying strap integrally formed by attaching together each end of the first longitudinal strap;

an upper bottle closing means which closes said drinking bottle and comprises a support ring which is connected to a securing strap portion having a free end; and a fastening buckle located at the free end of the second longitudinal strap and the free end of the securing strap portion, wherein the free ends of the second longitudinal strap and the securing strap portion are retained together in a longitudinally adjustable manner.

10. A carrier device according to claim 9, wherein said first longitudinal strap has a short first end provided with a clasp portion of a snap clasp combination adjacent the location of the container, and a long second end forming said shoulder strap and provided with a tongue portion releasably engageable with said clasp portion and a snap fit.

11. A carrier device according to claim 10, wherein said intersecting portions of said longitudinal and circumferential straps are securely fixed to one another by sewing.

12. A carrier device according to claim 11, wherein said longitudinal and circumferential straps of said strap assembly comprise a synthetic fiber reinforced textile material, particularly a high strength military rubbing.

13. A carrier device according to claim 12, wherein said drinking bottle has a conical neck portion provided with a screw cap spout and having securing strap portions, connected to said second longitudinal strap extending diametrically there across.

14. A carrier device according to claim 13, wherein said first and second longitudinal straps are of an adjustable length.

* * * * *